US010224651B2

(12) United States Patent
Uchida

(10) Patent No.: US 10,224,651 B2
(45) Date of Patent: Mar. 5, 2019

(54) CONNECTOR THAT ALLOWS THE RESONANT FREQUENCY OF A TRANSMISSION LINE TO BE GREATLY SHIFTED

(71) Applicant: DAI-ICHI SEIKO CO., LTD., Kyoto-shi, Kyoto (JP)

(72) Inventor: Tomoyuki Uchida, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/801,209

(22) Filed: Nov. 1, 2017

(65) Prior Publication Data

US 2018/0138606 A1 May 17, 2018

(30) Foreign Application Priority Data

Nov. 14, 2016 (JP) ..... 2016-221148

(51) Int. Cl.
*H01R 12/59* (2011.01)
*H01R 12/00* (2006.01)
(Continued)

(52) U.S. Cl.
CPC ..... *H01R 9/095* (2013.01); *H01R 12/57* (2013.01); *H01R 12/712* (2013.01); *H01R 12/91* (2013.01);
(Continued)

(58) Field of Classification Search
CPC ..... H01R 12/59; H01R 12/77; H01R 12/771; H01R 12/596; H01R 12/775
(Continued)

(56) References Cited

U.S. PATENT DOCUMENTS 8,043,114 B2 * 10/2011 Kaneko ..... H01R 12/714 439/497
9,966,681 B2 * 5/2018 Kurachi ..... H01R 12/775
(Continued)

FOREIGN PATENT DOCUMENTS

CN 102292875 A 12/2011
JP 2010-157367 A 7/2010
JP 2016-192412 A 11/2016

OTHER PUBLICATIONS

English Translation of Taiwan Office Action along with Original Office Action (Taiwan Pat. Appln. No. 106138700).
(Continued)

*Primary Examiner* — Abdullah A Riyami
*Assistant Examiner* — Justin M Kratt
(74) *Attorney, Agent, or Firm* — Howard & Howard Attorneys PLLC

(57) ABSTRACT

A receptacle connector is mounted on a board and is to be connected to a plug connector. An insulative housing is to be fitted to a housing of the plug connector. A plurality of electrically conductive contacts is arranged on the housing and connected to terminals (ground terminal and signal terminal) on the board, and are to be connected to electrically conductive contacts of the fitted plug connector. Among the plurality of contacts, at least one of a first contact and a second contact is configured so that the position at which the contact is in contact with a terminal (signal terminal or ground terminal) on the board can be adjusted, the first contact being connected to the signal terminal on the board, and the second contact being connected to the ground terminal on the board.

5 Claims, 14 Drawing Sheets

(51) Int. Cl.

| | |
|---|---|
| ***H01R 12/91*** | (2011.01) |
| ***H01R 13/40*** | (2006.01) |
| ***H01R 12/57*** | (2011.01) |
| ***H01R 12/71*** | (2011.01) |
| ***H01R 13/6474*** | (2011.01) |
| *H01R 12/77* | (2011.01) |
| *H01R 12/79* | (2011.01) |

(52) U.S. Cl.
CPC ..... *H01R 13/40* (2013.01); *H01R 13/6474* (2013.01); *H01R 12/59* (2013.01); *H01R 12/596* (2013.01); *H01R 12/77* (2013.01); *H01R 12/771* (2013.01); *H01R 12/775* (2013.01); *H01R 12/79* (2013.01)

(58) Field of Classification Search
USPC ..... 439/492, 497
See application file for complete search history.

(56) References Cited

U.S. PATENT DOCUMENTS

| | | | |
|---|---|---|---|
| 2011/0097933 | A1 | 4/2011 | Sommers et al. |
| 2014/0020246 | A1 | 1/2014 | Sommers et al. |

OTHER PUBLICATIONS

Notification of Reasons for Refusal (JP Application No. 2016-221148); dated Jun. 26, 2018; Includes English Translation.

* cited by examiner

CONNECTOR THAT ALLOWS THE RESONANT FREQUENCY OF A TRANSMISSION LINE TO BE GREATLY SHIFTED

CROSS-REFERENCE TO RELATED APPLICATION

This application claims the benefit of Japanese Patent Application No. 2016-221148, filed on Nov. 14, 2016, the entire disclosure of which is incorporated by reference herein.

FIELD

This application relates to a connector.

BACKGROUND

Patent Literature 1 discloses an electrical connector in which a signal line is connected to a circuit board by fitting a second connector connected to the signal line into a first connector mounted on the circuit board. The electrical connector provides high shielding performance due to surface contact, which is established during the fitting, between a first shell disposed in the first connector and a second shell disposed in the second connector.

Patent Literature 1 Unexamined Japanese Patent Application Kokai Publication No. 2010-157367

SUMMARY

In recent years, a range of much higher frequencies of signals has been used as signals are transmitted through cables at much higher speeds. In a range of higher frequencies, noise components included in the signal are more dominantly caused by crosstalk between contacts. It is known that crosstalk causes a greater noise component when a transmission line resonates and its resonant frequency is close to the frequency included in, for example, a digital signal (the frequency of a rectangular wave). Thus, in order to adequately reduce crosstalk, the resonant frequency of a transmission line has to be greatly shifted from the frequency included in a signal. However, changing the state of contact between shells, such as the change made by the aforementioned electrical connector, only produces a slight change in the resonant frequency of a transmission line. Thus, there has been the inconvenience of failing to adequately reduce crosstalk.

The present disclosure has been created in view of the foregoing circumstances, and an objective of the disclosure is to provide a connector that allows the resonant frequency of a transmission line to be greatly shifted from the frequency included in a signal.

To achieve the aforementioned objective, a connector according to the present disclosure is mounted on a board and is to be connected to a counterpart connector, the connector including:

an insulative housing to be fitted to the counterpart connector's housing; and a plurality of electrically conductive contacts that is arranged on the insulative housing and connected to terminals on the board, and that are to be connected to electrically conductive counterpart contacts of the fitted counterpart connector;

wherein, among the plurality of electrically conductive contacts, at least one of a first contact and a second contact is configured so that a position at which the contact is in contact with a terminal on the board can be adjusted, the first contact being connected to a signal terminal on the board, and the second contact being connected to a ground terminal on the board.

In this case, at least one of the first contact and the second contact may be configured to be able to come into contact with the terminal on the board at a plurality of different positions.

In addition, at least one of the first contact and the second contact may include:

a contact abutment that is to connect with the counterpart contact of the fitted counterpart connector;

a first board contact that is a free end extending outward and that is in contact with the terminal on the board; and a second board contact that is disposed between the contact abutment and the first board contact and that is additionally in contact with the terminal on the board.

The second board contact may include a bent portion of a strip portion extending between the contact abutment and the first board contact, and the bent portion may be in contact with the terminal on the board.

The second board contact may include a bent portion formed by cutting part of a strip portion extending between the contact abutment and the first board contact, and the bent portion may be in contact with the terminal on the board.

The first contact and the second contact may be of identical shape.

According to the present disclosure, in either of a signal transmission line that includes a contact and an on-board signal terminal and a ground transmission line that includes a contact and an on-board ground terminal, the position at which the contact is in contact with the on-board ground terminal or signal terminal can be adjusted. Thus, the wavelength with which the transmission line resonates can be changed, and accordingly, the resonant frequency of the transmission line can be greatly shifted from the frequency included in a signal.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

Embodiment 1 of the present disclosure will now be described in detail with reference to FIGS. 1 to 10.

Figure 1:
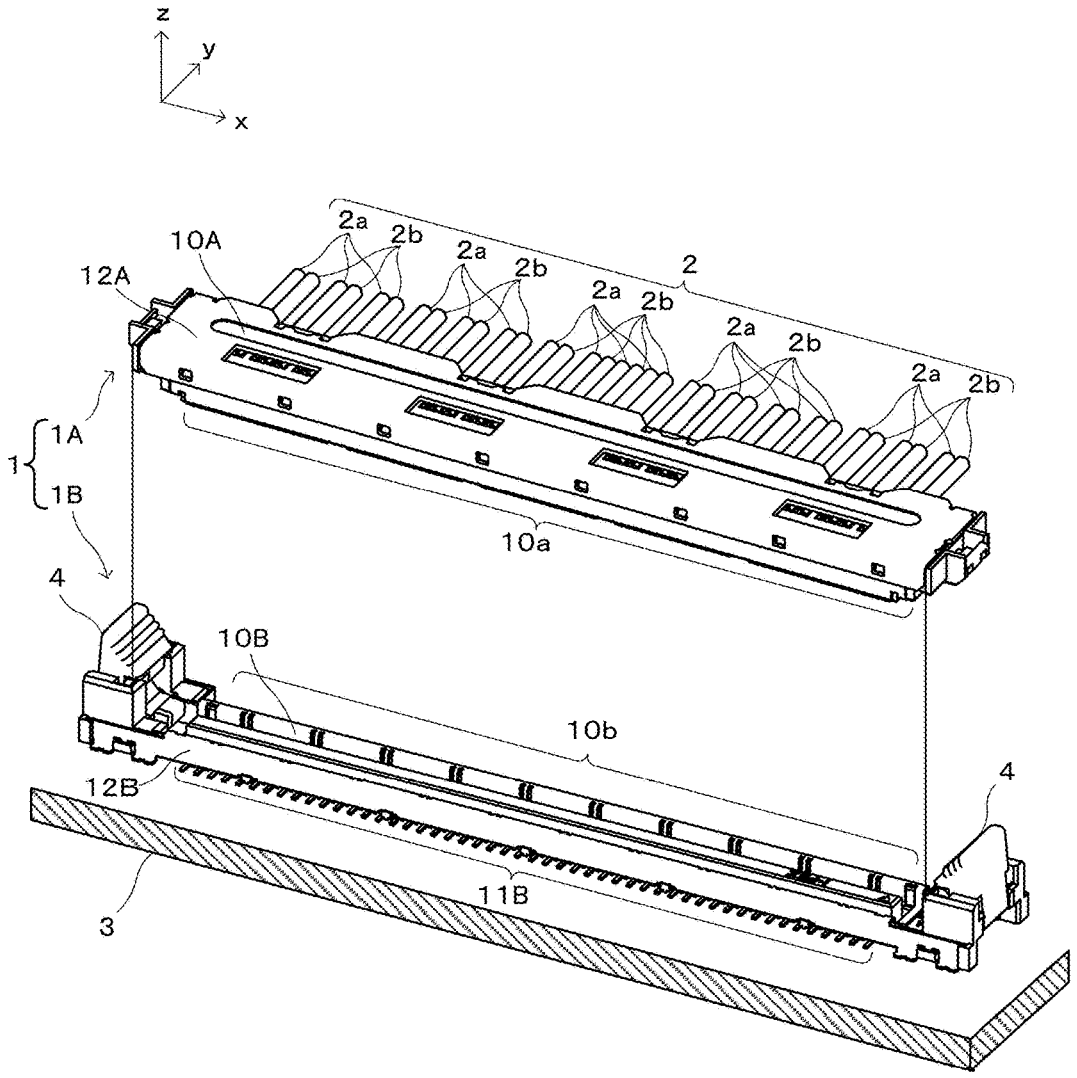
FIG. 1 is a perspective view illustrating a configuration of a connector according to Embodiment 1 of the present disclosure.

As illustrated in FIG. 1, the connector 1 includes a plug connector 1A and a receptacle connector 1B, the plug connector 1A serving as a counterpart connector. The plug connector 1A is connected to one end of each of a plurality of coaxial cables 2 arranged along a single direction (the x-axis direction). The receptacle connector 1B is mounted on a board 3 and is connected to terminals on the board 3.

A protrusion 10*a* protruding to the −z side is disposed in the plug connector 1A, while a recess 10*b* created toward the −z side is disposed in the receptacle connector 1B. The protrusion 10*a* of the plug connector 1A is slid into the recess 10*b* of the receptacle connector 1B, so that both connectors are securely fitted together. A tab 4 is disposed at both ends of the receptacle connector 1B with respect to the x-axis direction to lock the fitted plug connector 1A.

Figure 2A:
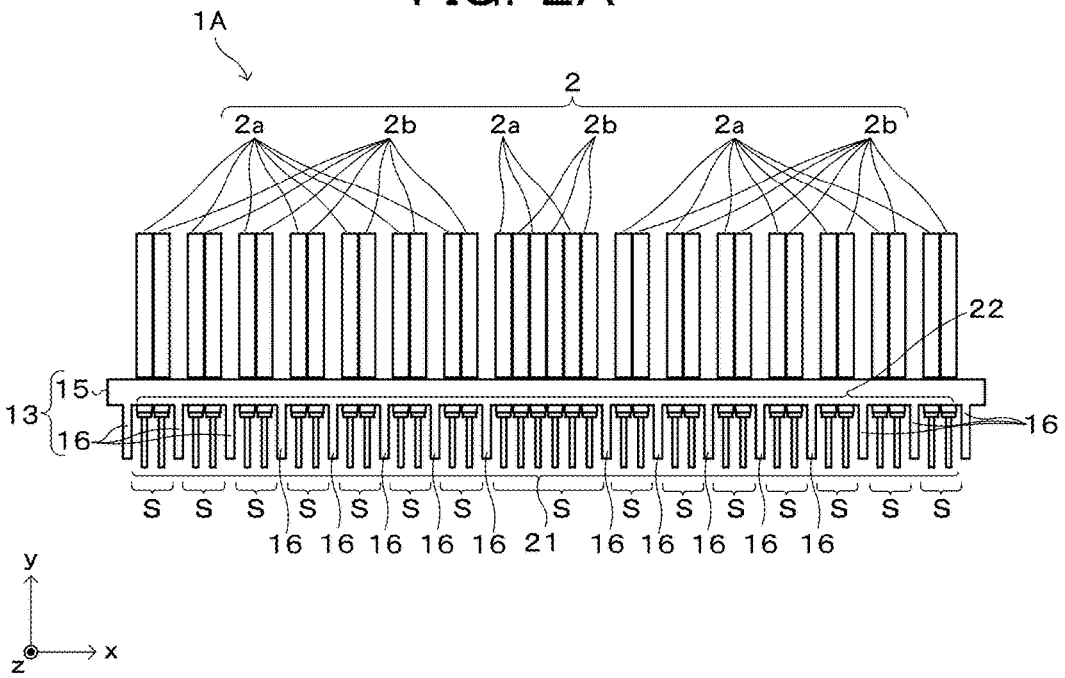
FIG. 2A is a top view of a ground bar attached to coaxial cables.
Figure 2B:
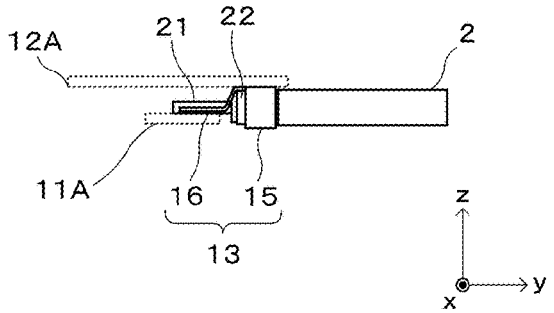
FIG. 2B is a side view illustrating how the ground bar is in contact with other members.

As illustrated in FIGS. 2A and 2B, a ground bar 13 is disposed in the plug connector 1A. The ground bar 13, which is an electrically conductive member, is in contact with an outer conductor 22 of the coaxial cable 2. The ground bar 13 is also in contact with a shell 12A of the plug connector 1A, and with some of the contacts 11A of the plug connector 1A. Some of the contacts 11A are those contacts 11A which are disposed at a position corresponding to the place where no coaxial cable 2 is disposed on the plug connector 1A.

When the plug connector 1A and the receptacle connector 1A are fitted together, a plurality of the contacts 11A in the plug connector 1A (see FIG. 9B) is connected to a plurality of contacts 11B in the receptacle connector 1B (see FIG. 9B) on a one-to-one basis. Furthermore, the fitting establishes connection between the electrically conductive shell 12A of the plug connector 1A (see FIG. 9B) and the electrically conductive shell 12B of the receptacle connector 1B (see FIG. 9B).

Figure 9A:
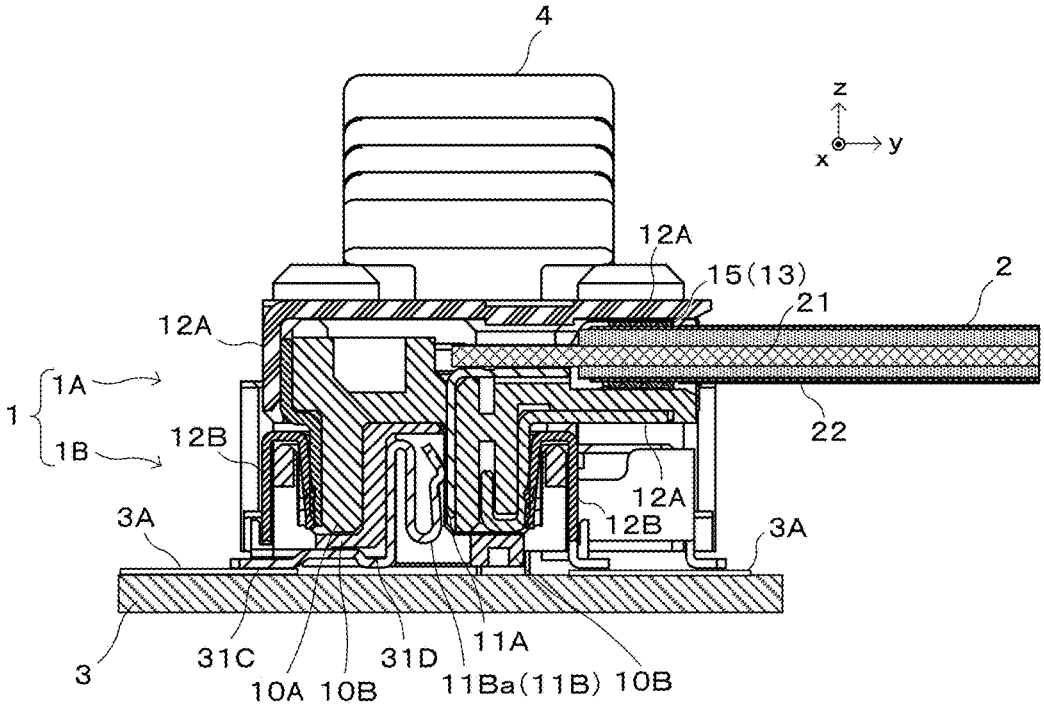
FIG. 9A is a cross-sectional view of the plug connector and the receptacle connector fitted together, corresponding to the cross-sectional view taken along A-A in FIG. 3.

When the connectors are fitted together, a signal transmission line is formed starting from the inner conductor 21 of the coaxial cable 2, to the contact 11A of the plug connector 1A, to the contact 11B of the receptacle connector 1B, and to the signal terminal 3A on the board 3 (see FIG. 9A). In addition, a ground transmission line is formed starting from the outer conductor 22 of the coaxial cable 2, to the ground bar 13, to the contact 11A and shell 12A of the plug connector 1A, to the contact 11B and shell 12B of the receptacle connector 1B, and to the ground terminal 3B on the board 3 (see FIG. 9B).

Figure 9B:
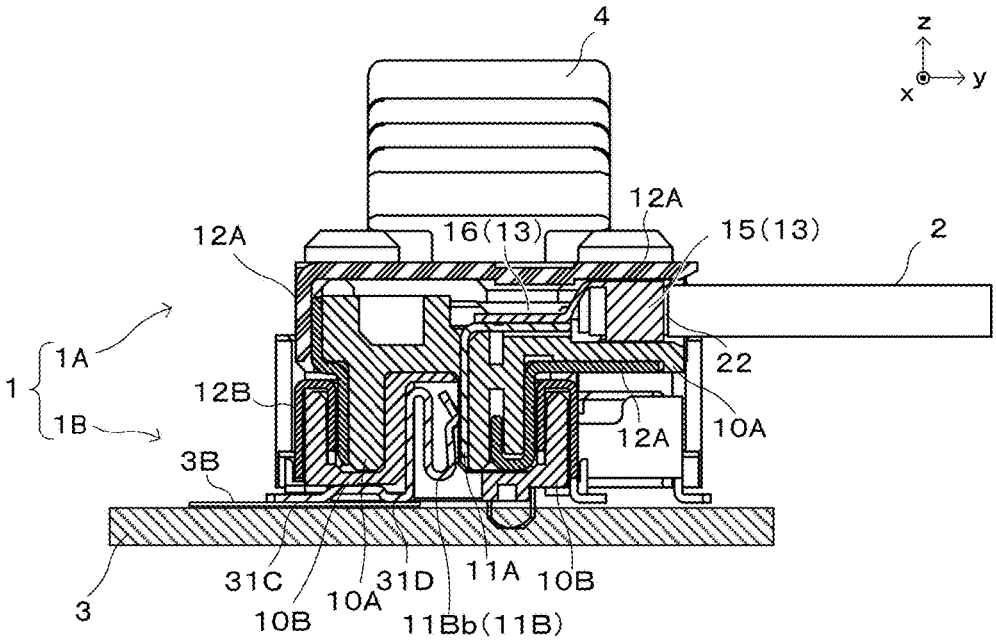
FIG. 9B is a cross-sectional view of the plug connector and the receptacle connector fitted together, corresponding to the cross-sectional view taken along B-B in FIG. 3.

Contacts 11B are divided into first contacts 11Ba connected to signal terminals 3A on the board 3 (see FIG. 9A) and second contacts 11Bb connected to ground terminals 3B on the board 3 (see FIG. 9B). In the present embodiment, the first and second contacts 11Ba and 11Bb are of the same shape, and both are configured so that the position at which each contact connects with the terminal (the ground terminal 3B or signal terminal 3A) on the board 3 can be adjusted.

In the present embodiment, each pair of coaxial cables 2 transmits differential signals. Cables forming a pair of coaxial cables 2 are hereinafter called coaxial cables 2*a* and 2*b*. As illustrated in FIG. 1, coaxial cables 2*a* and 2*b* form a pair and are alternately arranged along a single direction (the x-axis direction). As depicted in FIG. 2A, a plate-form part 16 of the ground bar 13 is disposed between pairs of coaxial cables 2*a* and 2*b*, where any two adjacent plate-form parts 16 are separated by a space S, except the middle portion with respect to the direction along which the coaxial cables are arranged.

The following describes the configuration of the connector 1 in more detail. As shown in FIGS. 2A to 4B, the plug connector 1A includes a housing 10A, a plurality of contacts 11A, a shell 12A, and a ground bar 13.

Figure 3:
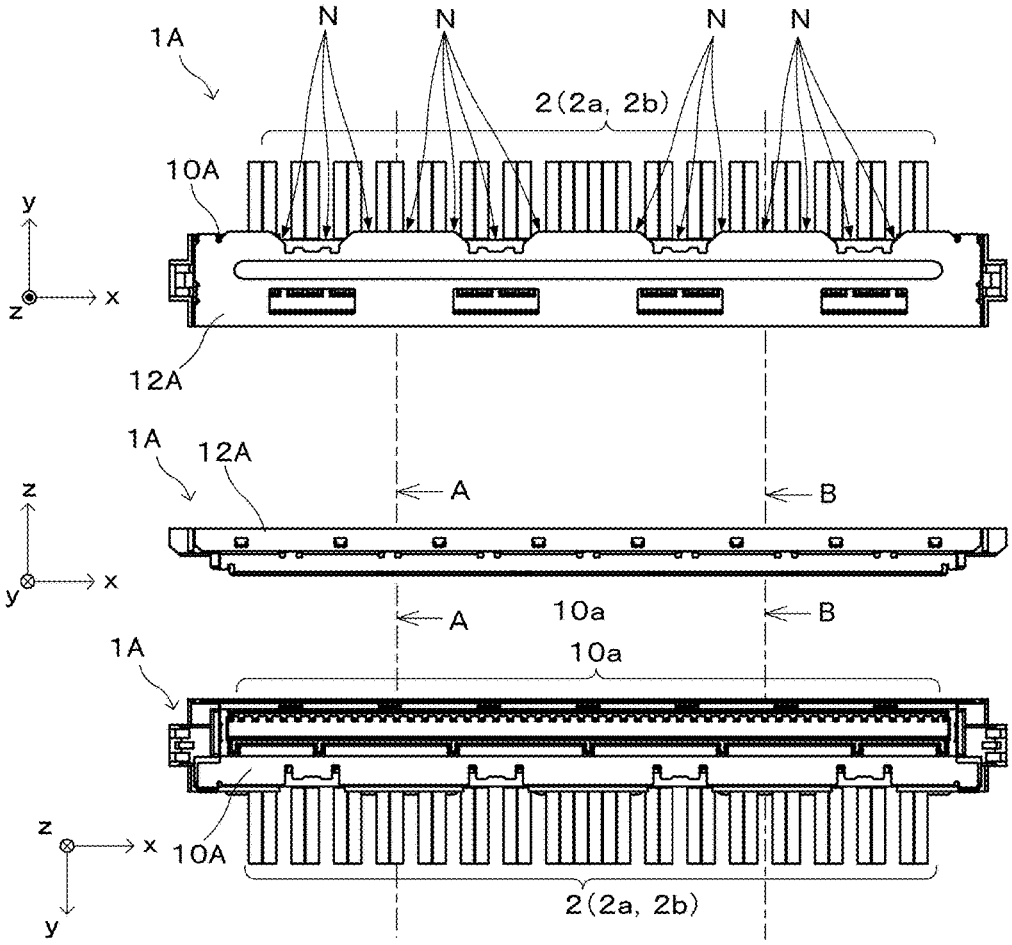
FIG. 3 is a three-view drawing (top view, side view, and bottom view) of the connector in FIG. 1.
Figure 4A:
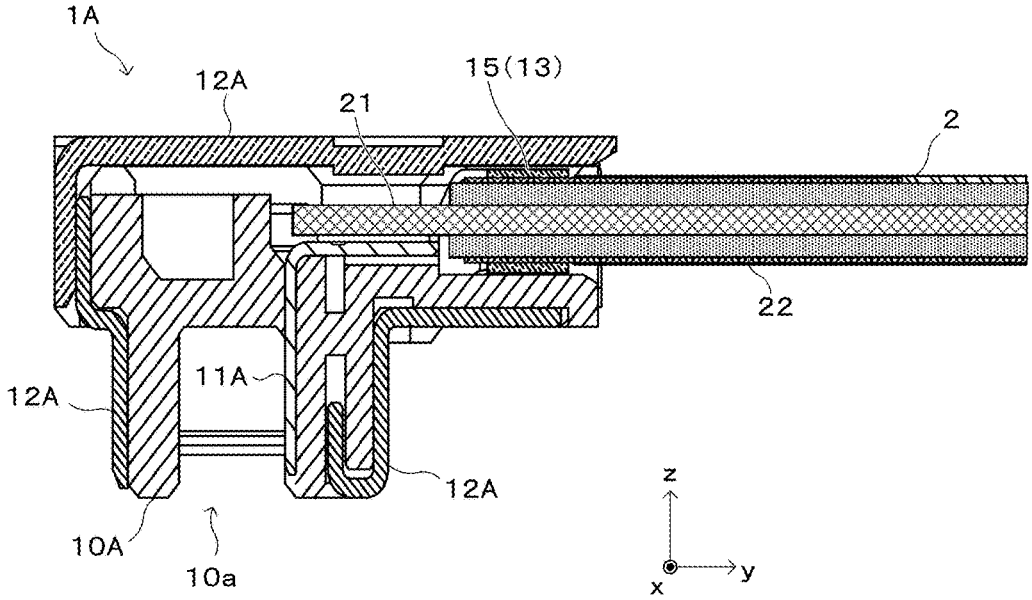
FIG. 4A is a cross-sectional view taken along A-A in FIG. 3.
Figure 4B:
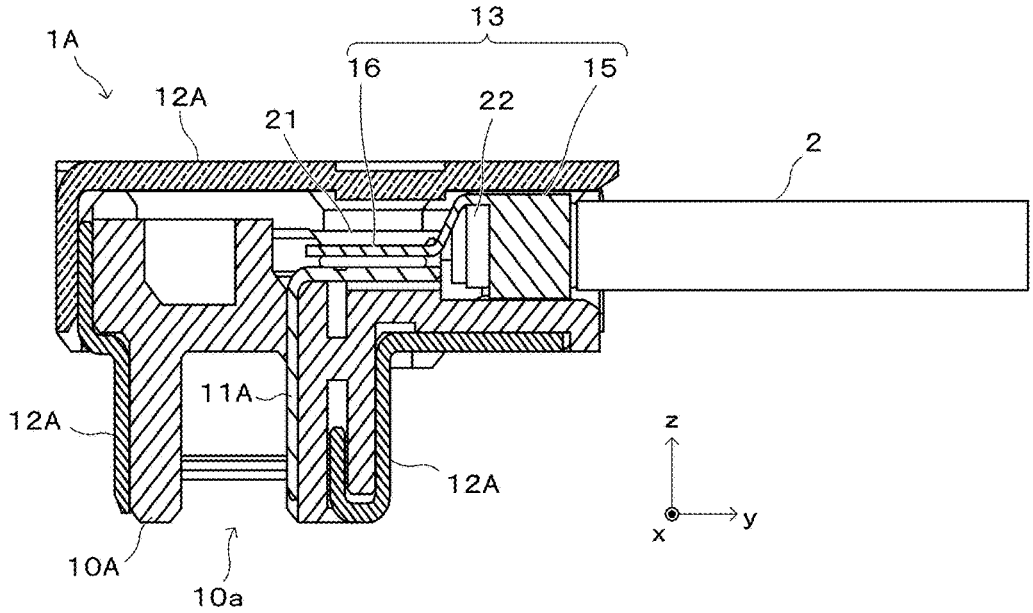
FIG. 4B is a cross-sectional view taken along B-B in FIG. 3.

As seen in FIG. 3, the housing 10A is a casing made of an insulating member (a resin, for example), and its whole outer surface is surrounded by the shell 12A. The housing 10A, whose longitudinal direction is along the x-axis direction, is long enough to connect to all the coaxial cables 2 arranged in a row. As illustrated in FIGS. 4A and 4B, which are cross-sectional views taken along A-A and B-B in FIG. 3, respectively, the housing 10A houses the plurality of contacts 11A and the ground bar 13. In addition, the protrusion 10*a* is disposed on the housing 10A.

Each of the contacts 11A is an electrically conductive member made of, for example, a metal. The contacts 11A are arranged in a row along the x-axis direction inside the housing 10A, in alignment with the array of the coaxial cables 2. Some of the plurality of the contacts 11A is connected to inner conductors 21 of the coaxial cables 2. The other remaining contacts 11A, that is, the contacts 11A other than those connected to the inner conductors 21 of the coaxial cables 2, are in contact with the ground bar 13. Specifically, as illustrated in FIG. 3, each contact 11A that is disposed corresponding to the position at which the coaxial cable 2 is disposed on the plug connector 1A is connected to the inner conductor 21 of the coaxial cable 2. In contrast, each contact 11A that is disposed corresponding to a position N, where no coaxial cable 2 is disposed on the plug connector 1A, is in contact with the ground bar 13 (more particularly, in contact with the plate-form part 16). When the plug connector 1A and the receptacle connector 1B are fitted together, these contacts 11A come into contact with the electrically conductive contacts 11B of the receptacle connector 1B on a one-to-one basis.

As illustrated in FIG. 3, the shell 12A is disposed so as to cover the housing 10A while being isolated from the plurality of contacts 11A. The shell 12A is an electrically conductive member to be coupled to the shell 12B of the fitted receptacle connector 1B.

The ground bar 13 is an electrically conductive member. As illustrated in FIG. 4B, the ground bar 13 brings the others of the plurality of contacts 11A, that is, those contacts 11A except the contacts 11A connected to the inner conductors 21 of the coaxial cables 2, into contact with the outer conductors 22 of the coaxial cables 2 and with the shell 12A.

As shown in FIGS. 4B, 2A, and 2B, the ground bar 13 includes a conductor-side connection 15 and a plurality of plate-form parts 16.

The conductor-side connection 15, which is a plate-form member extending in the x-axis direction as seen in FIG. 2A, is formed to surround and support all the outer conductors 22 of the arranged coaxial cables 2. As illustrated in FIGS. 2B and 4B, the conductor-side connection 15 is connected to the shell 12A as well as to the outer conductors 22 of the coaxial cables 2.

One end (the +y end) of each of the plurality of plate-form parts 16 is connected to the conductor-side connection 15. As illustrated in FIG. 2A, the other end of each plate-form part 16 extends along, but without touching, the inner conductor 21 of the coaxial cable 2. More specifically, the plate-form part 16 is formed to bend toward the −z side and then extend in the −y direction, as shown in FIG. 2B. As illustrated in FIG. 2A, the space S is formed between two adjacent plate-form parts 16, preventing the inner conductors 21 of the coaxial cables 2 from touching any of the plate-form parts 16. As illustrated in FIG. 4B, the plate-form part 16 extends downward to the −z side to be connected to the contact 11A through soldering, for example. The conductor-side connection 15 can be connected to the shell 12A through soldering.

Figure 5:
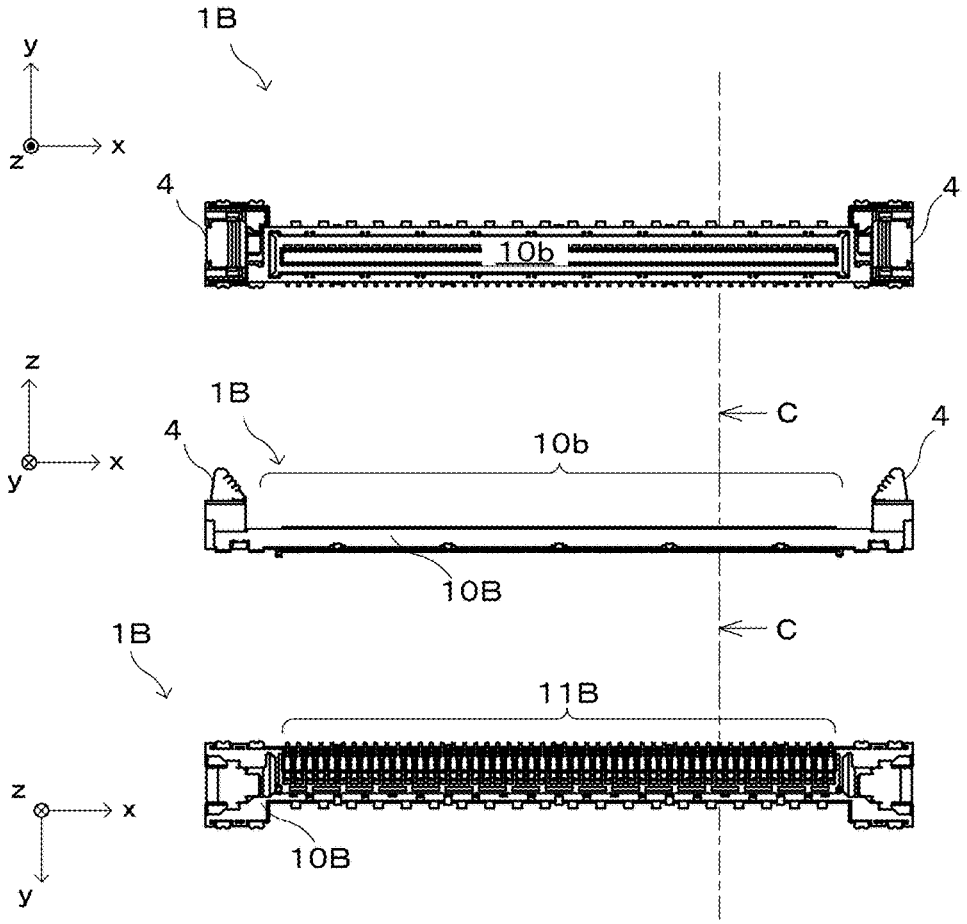
FIG. 5 is a three-view drawing (top view, side view, and bottom view) of a receptacle connector.

The following describes the configuration of the receptacle connector 1B. As illustrated in FIG. 5, which shows a three-view drawing, and in FIG. 6, which is a cross-sectional view taken along C-C in FIG. 5, the receptacle connector 1B includes a housing 10B, a plurality of contacts 11B, and a shell 12B.

Figure 6:
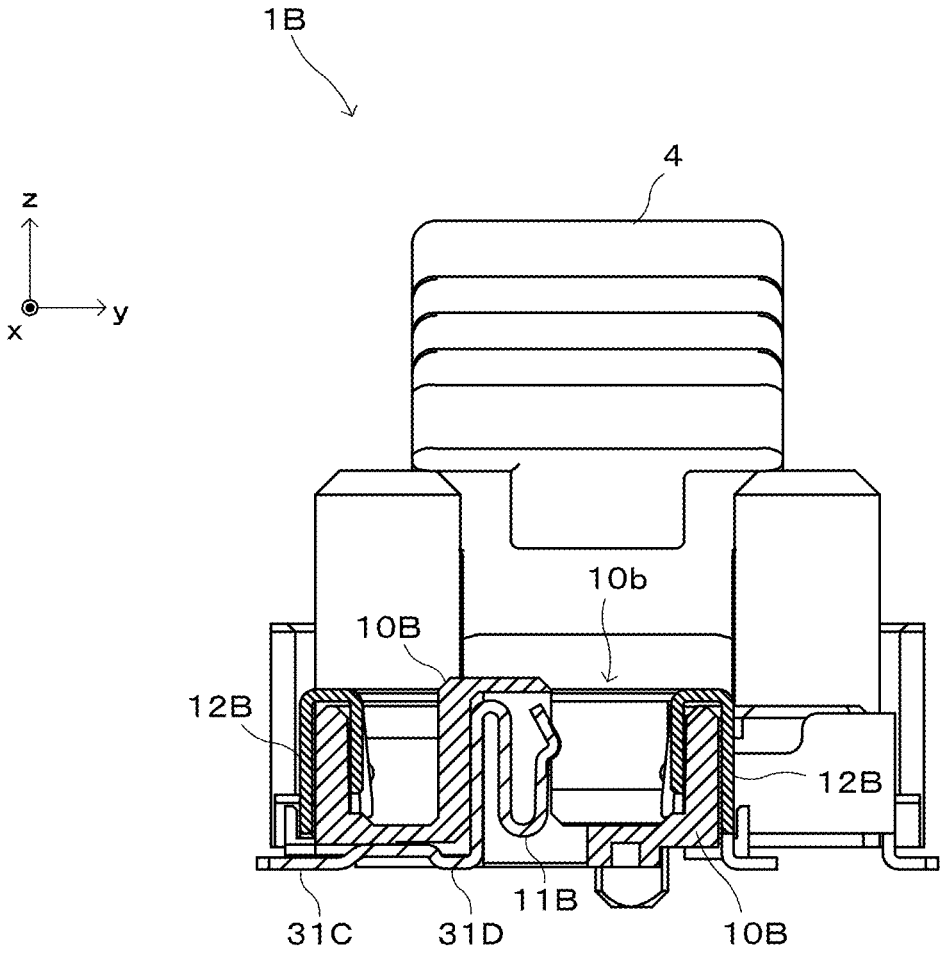
FIG. 6 is a cross-sectional view taken along C-C in FIG. 5.

The housing 10B is a casing in the form of an elongated plate and made of an insulating member (a resin, for example). The housing 10B, whose longitudinal direction is along the x-axis direction, is large enough to be fitted to the housing 10A of the plug connector 1A. As illustrated in FIG. 6, the housing 10B houses a plurality of contacts 11B. A recess 10*b* is formed on the housing 10B, and part of the contact 11B is protruding into the recess 10*b*.

The contacts 11B (first contact 11Ba and second contact 11Bb) are electrically conductive members made of, for example, a metal. The contacts 11B are arranged in a row along the x-axis direction inside the housing 10B, in alignment with the array of the contacts 11A.

Figure 7:
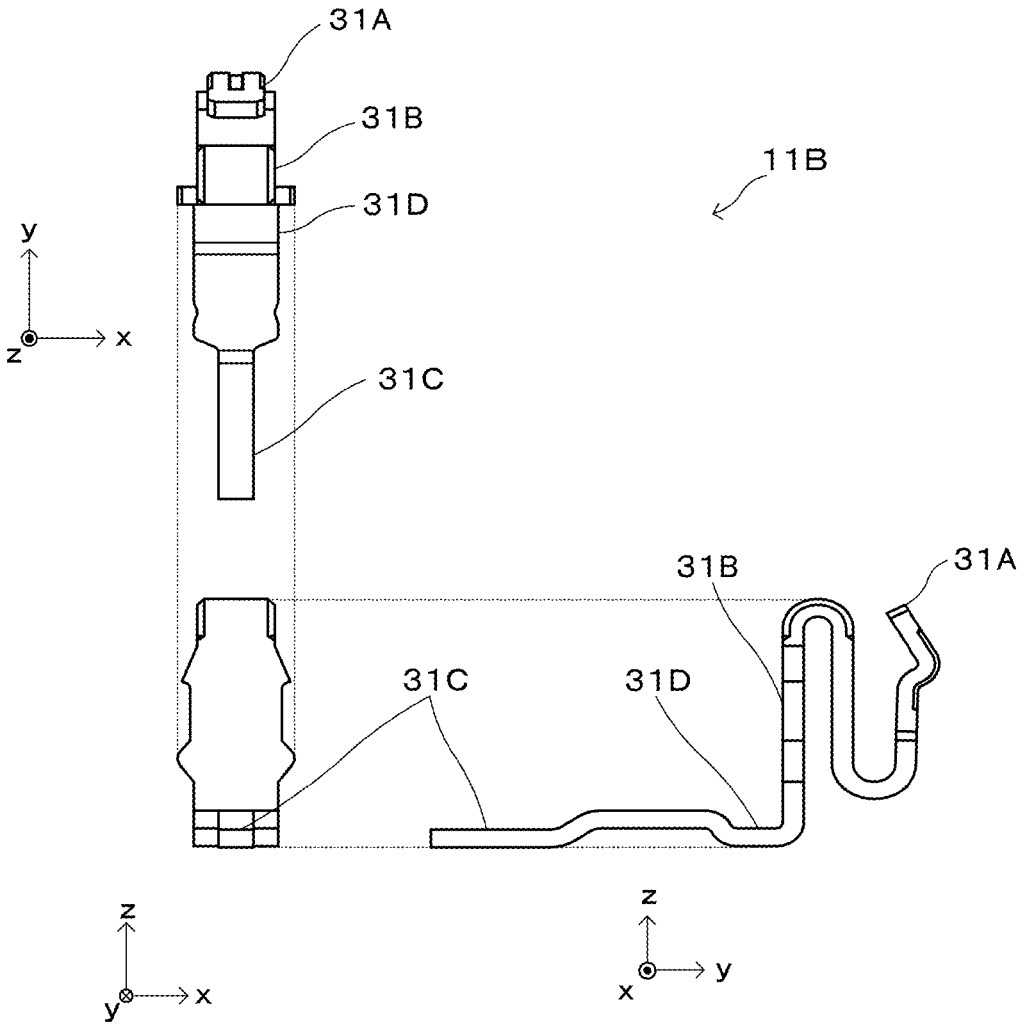
FIG. 7 is a three-view drawing (top view, side view, and side view) of a contact.

As illustrated in FIG. 7, the contact 11B includes a contact abutment 31A, a retention 31B, a first board contact 31C, and a second board contact 31D.

The contact abutment 31A comes into contact with, and becomes electrically connected to, the contact 11A of the fitted counterpart connector (the fitted plug connector 1A).

The retention 31B is retained on the housing 10B. Hence, the contact 11B is fastened to the housing 10B.

The first board contact 31C, which is a free end extending outward, is in contact with a terminal (either the ground terminal 3B or the signal terminal 3A) on the board 3. The second board contact 31D, which is disposed between the contact abutment 31A (the retention 31B) and the first board contact 31C, is additionally in contact with the terminal (either the ground terminal 3B or the signal terminal 3A) on the board 3. The second board contact 31D includes a bent portion of the strip portion extending between the contact abutment 31A and the first board contact 31C, and this bent portion connects with the terminal on the board.

As seen above, concerning the contacts 11B of the present embodiment, both the first and second contacts 11Ba and 11Bb are of the same shape, and are configured so that the position at which the contact 11B is connected to the signal terminal 3A or ground terminal 3B on the board 3 can be adjusted. Note that at least one of the first contact 11Ba and the second contact 11Bb need only be configured to be able to connect with the signal terminal 3A or ground terminal 3B on the board 3 at different positions.

When the plug connector 1A and the receptacle connector 1B are fitted together, the contacts 11B come into contact with the electrically conductive contacts 11A of the plug connector 1A on a one-to-one basis. Accordingly, as illustrated in FIG. 9A, the contact 11A connecting with the inner conductor 21 of the coaxial cable 2 is connected, via the contact 11B disposed corresponding to this contact 11A, to the signal terminal 3A on the board 3. In addition, as illustrated in FIG. 9B, the contact 11A not connecting with the inner conductor 21 of the coaxial cable 2 is connected, via the contact 11B disposed corresponding to this contact 11A, to the ground terminal 3B on the board 3.

The shell 12B, which is an electrically conductive member disposed on the housing 10B while being isolated from the plurality of contacts 11B, is coupled with the shell 12A of the fitted plug connector 1A. The shell 12B is connected to ground terminals 3B on the board 3 so as to be grounded.

The following describes operations of the connector 1.

First of all, the resonant frequency of a transmission line is adjusted in the connector 1. In order to reduce the influence of noise of a transmission signal, the adjustment is made so that the resonant frequency of a transmission line is shifted from the frequency included in, for example, a digital signal. For the purpose of the adjustment, the resonant frequency of a transmission line is shifted by, for example, soldering the second contact 11Bb to the ground terminal 3B.

Figure 10:
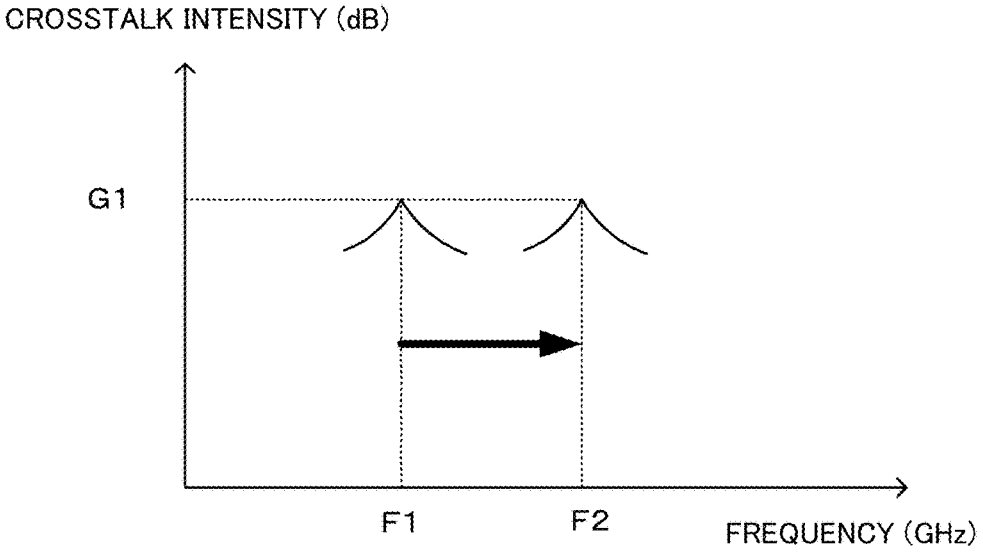
FIG. 10 is a graph indicating changes in the resonant frequency of a transmission line.

By way of example, it is assumed here that the frequency F1 (in GHz) is included in a transmitted signal as the fundamental frequency. In the case where the first board contact 31C is only used to make connection with the ground terminal 3B, if the resonant frequency of a transmission line is close to F1 (in GHz) (crosstalk intensity: G1 (in dB)) as indicated in FIG. 10, a transmitted signal may cause the transmission line to resonate, resulting in an increased crosstalk intensity.

In such case, the second board contact 31D in the second contact 11Bb is additionally soldered to the ground terminal 3B (that is, in addition to the first board contact 31C, the second board contact 31D is soldered to the ground terminal 3B). Hence, as indicated in FIG. 10, the resonant frequency of the transmission line can be shifted from F1 (in GHz) to, for example, F2 (in GHz), which reduces the resonance attributable to crosstalk at the fundamental frequency F1 (in GHz) of the transmission line. As a result, the influence on the fundamental frequency F1 (in GHz) can be reduced to a level lower than the intensity G1 (in dB).

Figure 8:
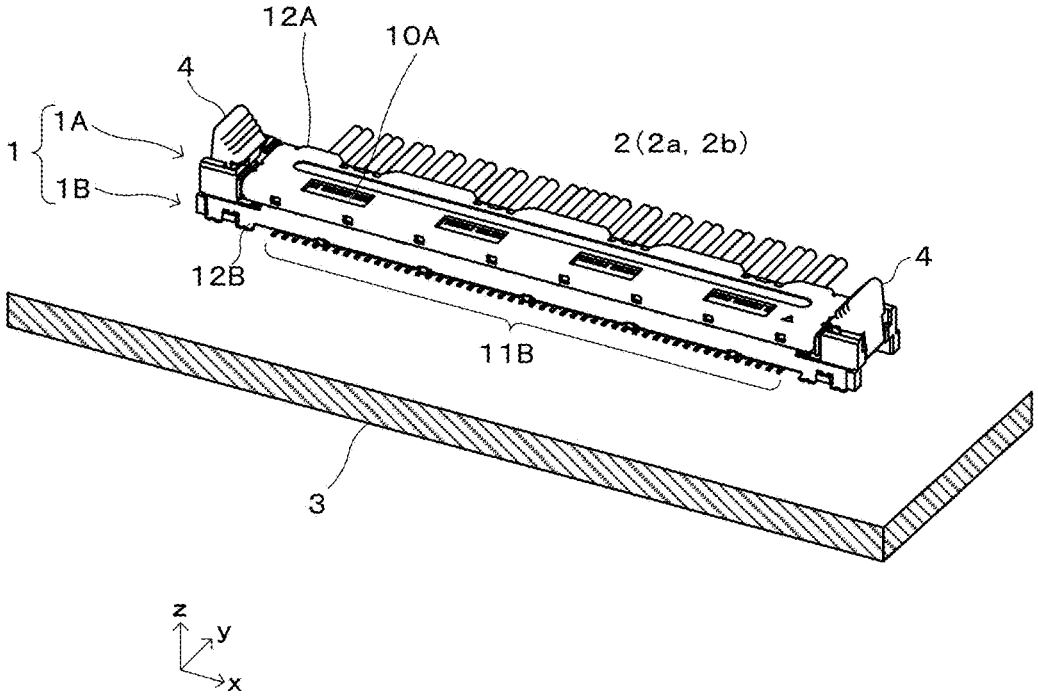
FIG. 8 is a perspective view of the plug connector and the receptacle connector fitted together.

The receptacle connector 1B, in which the resonant frequency of a transmission line has been shifted from the frequency included in a signal as described above, is mounted on the board 3, while the plug connector 1A is connected to a plurality of coaxial cables 2 as illustrated in FIG. 8.

When the plug connector 1A and the receptacle connector 1B are fitted together, as illustrated in FIGS. 9A and 9B, the contacts 11A of the plug connector 1A are connected to the contacts 11B of the receptacle connector 1B on a one-to-one basis. Furthermore, connection is established between the electrically conductive shell 12A of the plug connector 1A and the electrically conductive shell 12B of the receptacle connector 1B.

Consequently, as illustrated in FIG. 9A, a signal transmission line is formed starting from the inner conductor 21 of the coaxial cable 2, to the contact 11A of the plug connector 1A, to the contact 11B of the receptacle connector 1B, and to the signal terminal 3A on the board 3. In addition, as illustrated in FIG. 9B, a ground transmission line is formed starting from the outer conductor 22 of the coaxial cable 2, to the ground bar 13, to the contact 11A and shell 12A of the plug connector 1A, to the contact 11B and shell 12B of the receptacle connector 1B, and to the ground terminal 3B on the board 3.

According to the present embodiment, in the contact 11B (the first contact 11Ba) connected to the inner conductor 21 of the coaxial cable 2, the first board contact 31C is soldered to the signal terminal 3A, whereas the second board contact 31D is neither in contact with, nor soldered to, the signal terminal 3A, with respect to every pair of coaxial cables (2*a* and 2*b*). In the contact 11B (the second contact 11Bb) connected to the outer conductor 22 of the coaxial cable 2, the first board contact 31C is soldered to the ground terminal 3B, and the second board contact 31D is also soldered to the ground terminal 3B. As a result, with respect to every pair of coaxial cables (2*a* and 2*b*), the resonant frequency of a transmission line can be shifted from the frequency included in a signal, thus reducing crosstalk.

In this way, the connector 1 enables the resonant frequency of a transmission line to be shifted from the frequency included in a signal to reduce crosstalk by adjusting the position at which the second contact 11Bb is in contact with the ground terminal 3B.

However, in the contact 11B (the second contact 11Bb) connected to the outer conductor 22 of the coaxial cable 2, having both of the first board contact 31C and the second board contact 31D soldered to the ground terminal 3B may possibly cause the resonant frequency of a transmission line to match the frequency included in a signal, resulting in a higher crosstalk intensity. In this case, in the contact 11B (the first contact 11Ba) connected to the inner conductor 21 of the coaxial cable 2, the crosstalk intensity can be reduced by soldering the second board contact 31D to the signal terminal 3A, as well as soldering the first board contact 31C to the signal terminal 3A.

Signals are transmitted from the coaxial cables 2 (2*a* and 2*b*) through the connector 1 to the board 3 with the crosstalk kept at a lower level. On the board 3, the difference between the signal level in the coaxial cable 2*a* and the signal level in the coaxial cable 2*b* is obtained to detect a final signal level. Signals are transmitted with a reduced crosstalk level, and thus signals can be accurately transmitted without being susceptible to noise.

As described above, according to the present embodiment, in either of a signal transmission line that includes the contact 11B (first contact 11Ba) and the signal terminal 3A on the board 3 and a ground transmission line that includes the contact 11B (second contact 11Bb) and the ground terminal 3B on the board 3, the position at which the contact 11B is in contact with the signal terminal 3A or the ground terminal 3B can be adjusted. As a result, the resonant frequency of a transmission line can be greatly shifted from the frequency included in a signal.

In other words, by adjusting the position at which the contact 11B is in contact with either the signal terminal 3A or the ground terminal 3B, the wavelength with which a ground transmission line resonates can be changed, and accordingly the resonant frequency of the transmission line can be shifted from the frequency included in a signal.

Frequencies included in transmitted signals are expected to be much higher in the future. As the frequency included in a transmitted signal becomes much higher, crosstalk will be more influential, and shifting the resonant frequency of a transmission line will be more important.

Embodiment 2

Embodiment 2 of the present disclosure will now be described with reference to FIGS. 11 to 14.

The present embodiment is different from Embodiment 1 in that a connector 1' according to the present embodiment (see FIG. 13) includes a receptacle connector 1B' instead of the receptacle connector 1B. The receptacle connector 1B' includes a contact 11B' instead of the contact 11B.

Figure 11:
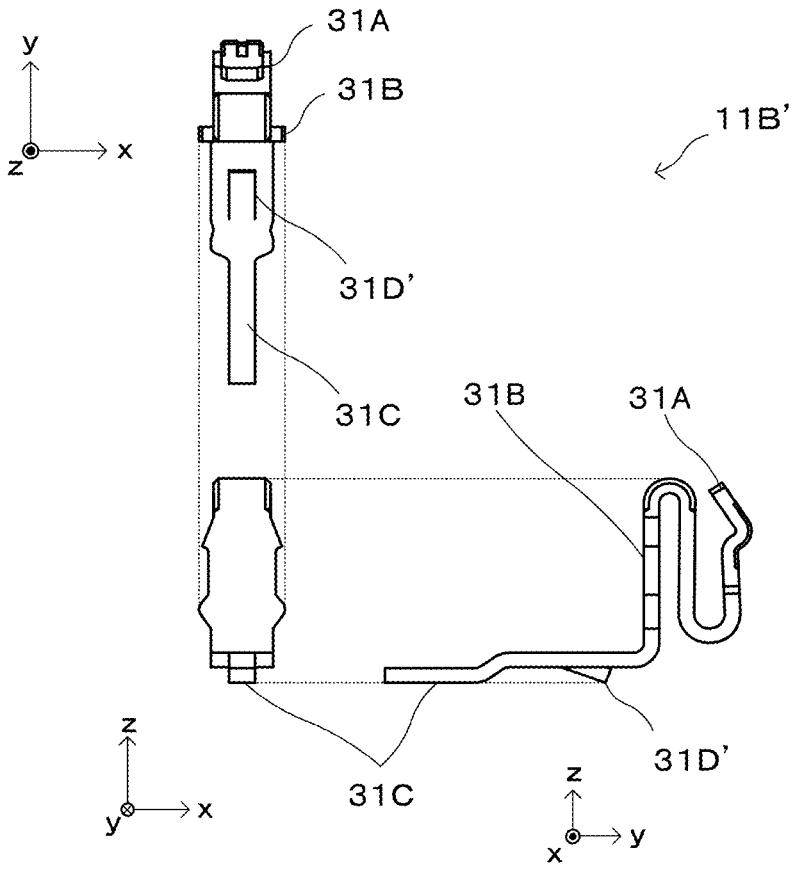
FIG. 11 is a three-view drawing (top view, side view, and side view) of a contact according to Embodiment 2 of the present disclosure.
Figure 12:
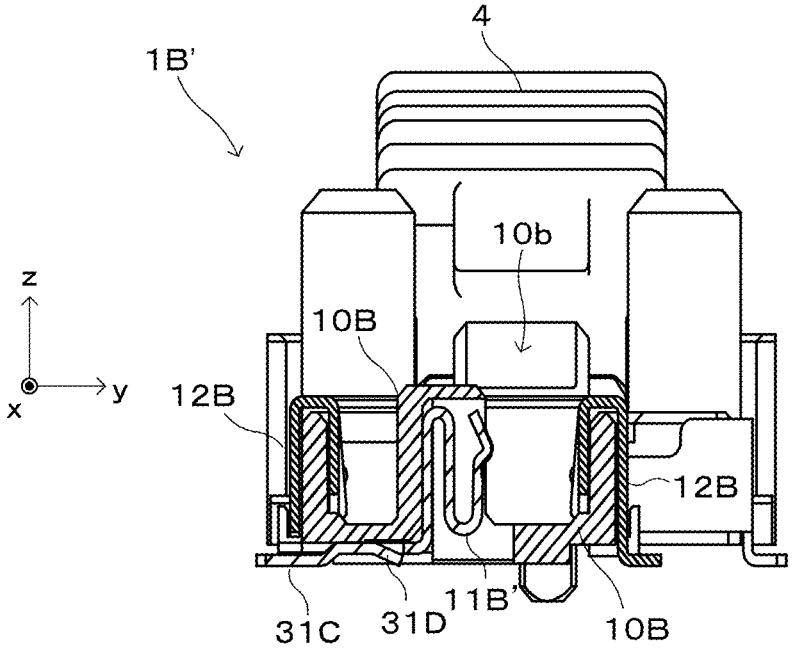
FIG. 12 is a cross-sectional view of a receptacle connector according to Embodiment 2.

As illustrated in FIG. 11, the contact 11B' includes a second board contact 31D' instead of the second board contact 31D. The second board contact 31D' is the same as the second board contact 31D, which is formed of part of the strip portion extending between the contact abutment 31A and the first board contact 31C, except that, in the contact 11B', part of the strip portion is cut to form a bent portion and this bent portion connects with a terminal (the signal terminal 3A or the ground terminal 3B) on the board 3.

Figure 13A:
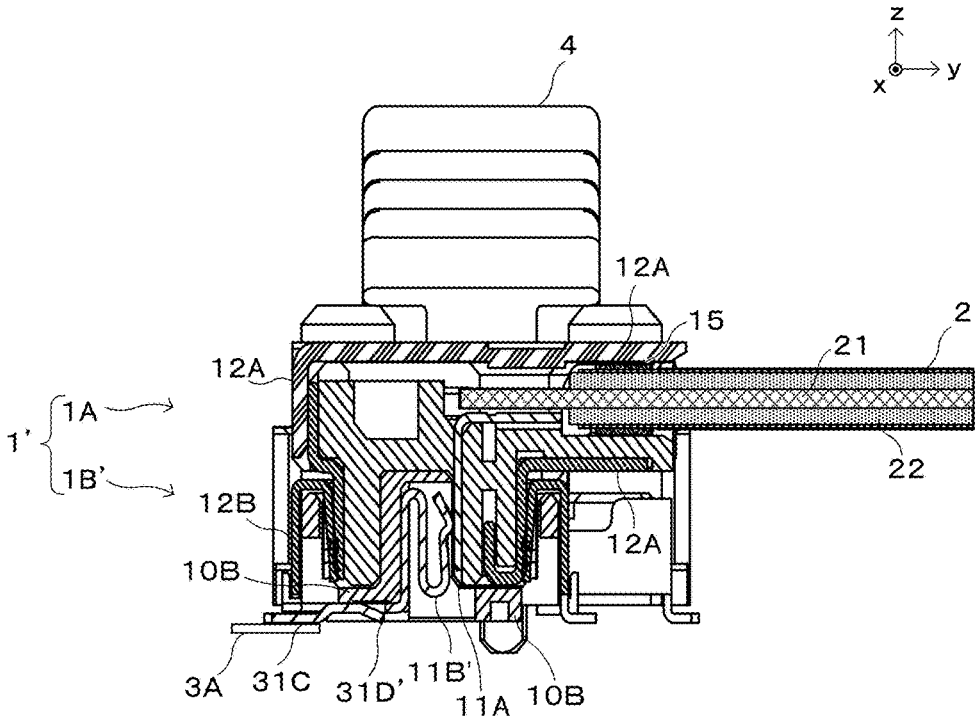
FIG. 13A is a cross-sectional view of the plug connector and the receptacle connector fitted together according to Embodiment 2, corresponding to the cross-sectional view taken along A-A in FIG. 3.
Figure 13B:
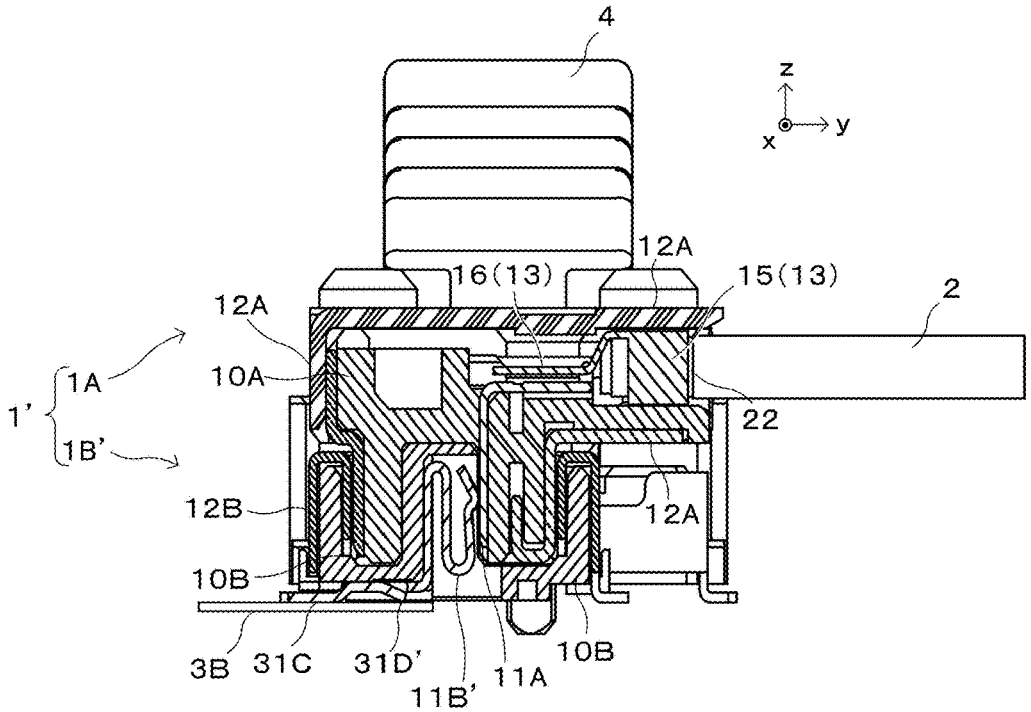
FIG. 13B is a cross-sectional view of the plug connector and the receptacle connector fitted together according to Embodiment 2, corresponding to the cross-sectional view taken along B-B in FIG. 3.

When the plug connector 1A and the receptacle connector 1B' are fitted together, the contacts 11A of the plug connector 1A are connected to the contacts 11B' of the receptacle connector 1B' on a one-to-one basis, as illustrated in FIGS. 13A and 13B. Furthermore, connection is established between the electrically conductive shell 12A of the plug connector 1A and the electrically conductive shell 12B of the receptacle connector 1B'.

Consequently, as illustrated in FIG. 13A, a signal transmission line is formed starting from the inner conductor 21 of the coaxial cable 2, to the contact 11A of the plug connector 1A, to the contact 11B' (the first contact 11Ba) of the receptacle connector 1B', and to the signal terminal 3A on the board 3. In addition, as illustrated in FIG. 13B, a ground transmission line is formed starting from the outer conductor 22 of the coaxial cable 2, to the ground bar 13, to the contact 11A and shell 12A of the plug connector 1A, to the contact 11B' (the second contact 11Bb) and shell 12B of the receptacle connector 1B', and to the ground terminal 3B on the board 3.

According to the present embodiment, in the contact 11B' (the second contact 11Bb) connected to the outer conductor 22 of the coaxial cable 2, the ground terminal 3B is soldered to both of the first and second board contacts 31C and 31D'. As a result, the resonant frequency of a transmission line can be shifted from the frequency included in a signal, thus reducing crosstalk.

Figure 14:
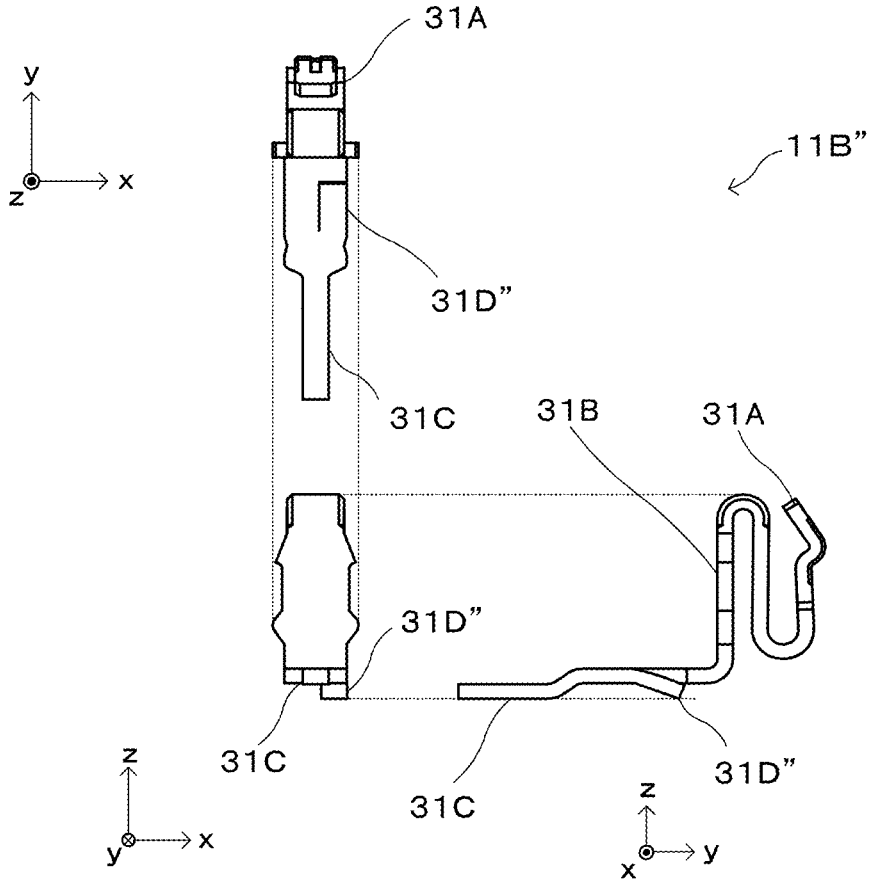
FIG. 14 is a three-view drawing (top view, side view, and side view) of a contact according to another example.

Note that a contact 11B" illustrated in FIG. 14 may be used instead of the contact 11B' in either of the receptacle connectors 1B and 1B'. In the contact 11B", a second board contact 31D" is formed by cutting a side end, not a center, of the strip portion.

In the foregoing individual embodiments, every contact 11B or 11B' is configured so that the position at which the contact 11B or 11B' is in contact with a terminal (the signal terminal 3A or the ground terminal 3B) on the board can be adjusted, but the present disclosure is not limited to these embodiments. At least one of the first contact 11Ba and the second contact 11Bb, which form the contact 11B or 11B', need only be configured so that the position at which the contact is in contact with a terminal (the signal terminal 3A or the ground terminal 3B) on the board 3 can be adjusted. In other words, at least one of the first contact 11Ba and the second contact 11Bb need only be configured to be able to connect with a terminal on the board 3 at different positions.

In addition, some of the plurality of first contacts 11Ba each may include the second board contact 31D, 31D', or 31D", whereas the remaining others of the plurality of first contacts 11Ba each may include no second board contact 31D, 31D', or 31D" (and include the contact abutment 31A, the retention 31B, and the first board contact 31C). Likewise, some of the plurality of second contacts 11Bb may include the second board contact 31D, 31D', or 31D", whereas the remaining others may include no second board contact 31D, 31D', or 31D" (and include the contact abutment 31A, the retention 31B, and the first board contact 31C).

In the foregoing individual embodiments, the contact 11B is in contact with a terminal (the signal terminal 3A or the ground terminal 3B) on the board 3 at two positions, but the present disclosure is not limited to these embodiments. The contact may be in contact with the terminal at three or more positions.

In the foregoing individual embodiments, each of the connectors 1 and 1' includes a pair of coaxial cables (2*a* and 2*b*) through which differential signals are transmitted, but the present disclosure is not limited to these embodiments. It is a matter of course that the present disclosure can be applied to the connector that transmits non-differential signals through a single coaxial cable 2.

In the foregoing individual embodiments, signals are transmitted from the coaxial cable 2 to a terminal on the board 3, but the present disclosure is not limited to these embodiments. The present disclosure can be applied to the case where signals are transmitted from a terminal on the board 3 to the coaxial cable 2.

The connector according to the present disclosure can be used to connect between a coaxial cable and an on-board circuit to transmit high frequency signals.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A connector that is mounted on a board and is to be connected to a counterpart connector, the connector comprising:

an insulative housing to be fitted to the counterpart connector's housing; and a plurality of electrically conductive contacts that is arranged on the insulative housing and connected to terminals on the board, and that are to be connected to electrically conductive counterpart contacts of the fitted counterpart connector;

wherein, among the plurality of electrically conductive contacts, at least one of a first contact and a second contact comprises board contacts connectable to a terminal on the board and is bent to provide a portion that is disposed between the board contacts and is not in contact with the terminal on the board, the first contact being connected to a signal terminal on the board, and the second contact being connected to a ground terminal on the board.

2. The connector according to claim 1, wherein at least one of the first contact and the second contact further comprises:

a contact abutment that is to connect with the counterpart contact of the fitted counterpart connector, and the board contacts of the at least one of the first contact and the second contact includes a first board contact that is a free end extending outward and that is in contact with the terminal on the board;

a second board contact that is disposed between the contact abutment and the first board contact and that is additionally in contact with the terminal on the board.

3. The connector according to claim 2, wherein the second board contact comprises a bent portion of a strip portion extending between the contact abutment and the first board contact, and the bent portion is in contact with the terminal on the board.

4. The connector according to claim 2, wherein the second board contact comprises a bent portion formed by cutting part of a strip portion extending between the contact abutment and the first board contact, and the bent portion is in contact with the terminal on the board.

5. The connector according to claim 1, wherein the first contact and the second contact are of identical shape.

* * * * *